US009541934B2

(12) United States Patent
Wei

(10) Patent No.: US 9,541,934 B2
(45) Date of Patent: Jan. 10, 2017

(54) LINEAR REGULATOR CIRCUIT

(71) Applicant: Chin-Yuan Wei, Miaoli (TW)

(72) Inventor: Chin-Yuan Wei, Miaoli (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 14/739,971

(22) Filed: Jun. 15, 2015

(65) Prior Publication Data

US 2016/0363945 A1 Dec. 15, 2016

(51) Int. Cl.
*G05F 5/00* (2006.01)
*G05F 1/575* (2006.01)

(52) U.S. Cl.
CPC ..... *G05F 1/575* (2013.01)

(58) Field of Classification Search
CPC ..... G05F 1/575; G05F 1/56; G05F 1/57; G05F 1/67
USPC ..... 323/273, 274, 275–279, 299, 303
See application file for complete search history.

(56) References Cited

U.S. PATENT DOCUMENTS 6,541,946 B1 4/2003 Chen et al.
2015/0168971 A1* 6/2015 Tomioka ..... G05F 1/562 323/275

* cited by examiner

*Primary Examiner* — Nguyen Tran
(74) *Attorney, Agent, or Firm* — Tung & Associates

(57) ABSTRACT

A linear regulator circuit includes: a power switch having a first terminal coupled to an input voltage, a second terminal coupled to an output voltage, and a control terminal; an error amplifier, controlling the control terminal of the power switch according to a comparison between a feedback signal related to the output voltage and a reference signal; a first node, coupled between the error amplifier and the power switch; a transistor, coupled to the first node to provide a current path; and a body control unit, coupled between the input voltage and a body of the transistor, wherein when a change occurs in the input voltage, the body control unit controls a body voltage of the transistor to adjust a current in the current path, to correspondingly control a voltage of the first node, such that the control terminal of the power switch responds to the change.

8 Claims, 4 Drawing Sheets

LINEAR REGULATOR CIRCUIT

BACKGROUND OF THE INVENTION

Field of Invention

The present invention relates to a linear regulator circuit, in particular a linear regulator circuit wherein a control terminal of a power switch can quickly respond to a variation in the input voltage by means of a body control unit coupled between the input voltage and a body of a transistor.

Description of Related Art

FIG. 1 shows a prior art linear regulator circuit 10 for converting an input voltage Vin to an output voltage Vo, wherein a power switch 11 is coupled between the input voltage Vin and the output voltage Vo, and an error amplifier 12 compares a feedback signal Vr which relates to the output voltage Vo (for example, the feedback signal Vr is generated from a divided voltage of the output voltage Vo) and a reference signal Vref, to generate an output controlling a control terminal 111 of the power switch 11, such that the power switch 11 operates to convert the input voltage Vin to the output voltage Vo.

Please refer to the waveforms of the input voltage Vin and the output voltage Vo shown at the right side of FIG. 1. When there is a noise (transient variation) in the input voltage, it can cause corresponding noises in the output voltage, to degrade the quality of the output voltage (poor power supply rejection ratio (PSRR)). For a better PSRR, U.S. Pat. No. 6,541,946 proposes a solution; however, the solution requires a large current source and a large capacitor, which increases the cost of the circuit and needs a larger circuit area.

In view of the demerit of the prior art, the present invention provides a linear regulator circuit for solving the above problem.

SUMMARY OF THE INVENTION

In one perspective, the present invention provides a linear regulator circuit includes a power switch, an error amplifier, a first node, a transistor, and a body control unit. The power switch have a first terminal coupled to an input voltage, a second terminal coupled to an output voltage, and a control terminal. The error amplifier controls the control terminal of the power switch according to a comparison between a feedback signal related to the output voltage and a reference signal. The first node is coupled between the error amplifier and the power switch. The transistor is coupled to the first node, to provide a current path to the first node. The body control unit is coupled to the input voltage for controlling a body of the transistor, wherein when a change occurs in the input voltage, the body control unit controls a body voltage of the transistor to adjust a current in the current path, to correspondingly control a voltage at the first node, such that the control terminal of the power switch quickly responds to the change.

In one embodiment of the present invention, the control terminal of the transistor is not directly connected to a capacitor.

In one embodiment, the linear regulator circuit of further includes a feedback circuit, which is coupled between the output voltage and the error amplifier, and generates the feedback signal to the error amplifier according to the output voltage.

In one embodiment of the present invention, the body control unit includes a high pass filter, which is coupled between the input voltage and the body of the transistor. In another embodiment, the high pass filter includes a capacitor and a resistor in serial connection, and the capacitor is coupled between the input voltage and the resistor, and the resistor is coupled between the capacitor and ground, and a second node between the capacitor and the resistor is coupled to the body of the transistor.

In one embodiment, a control terminal of the transistor is coupled to another transistor, such that the transistor and the another transistor form a current mirror circuit. In another embodiment, the another transistor is coupled to a current source.

In another embodiment, the linear regulator circuit further includes an amplifier, which is coupled between the first node and the control terminal of the power switch, to amplify a voltage at the first node for controlling the power switch.

The objectives, technical details, features, and effects of the present invention will be better understood with regard to the detailed description of the embodiments below, with reference to the drawings.

DESCRIPTION OF THE PREFERRED EMBODIMENTS

The drawings as referred to throughout the description of the present invention are for illustrative purpose only, to show the interrelations between the circuits and/or devices, but not drawn according to actual scale.

Figure 1:
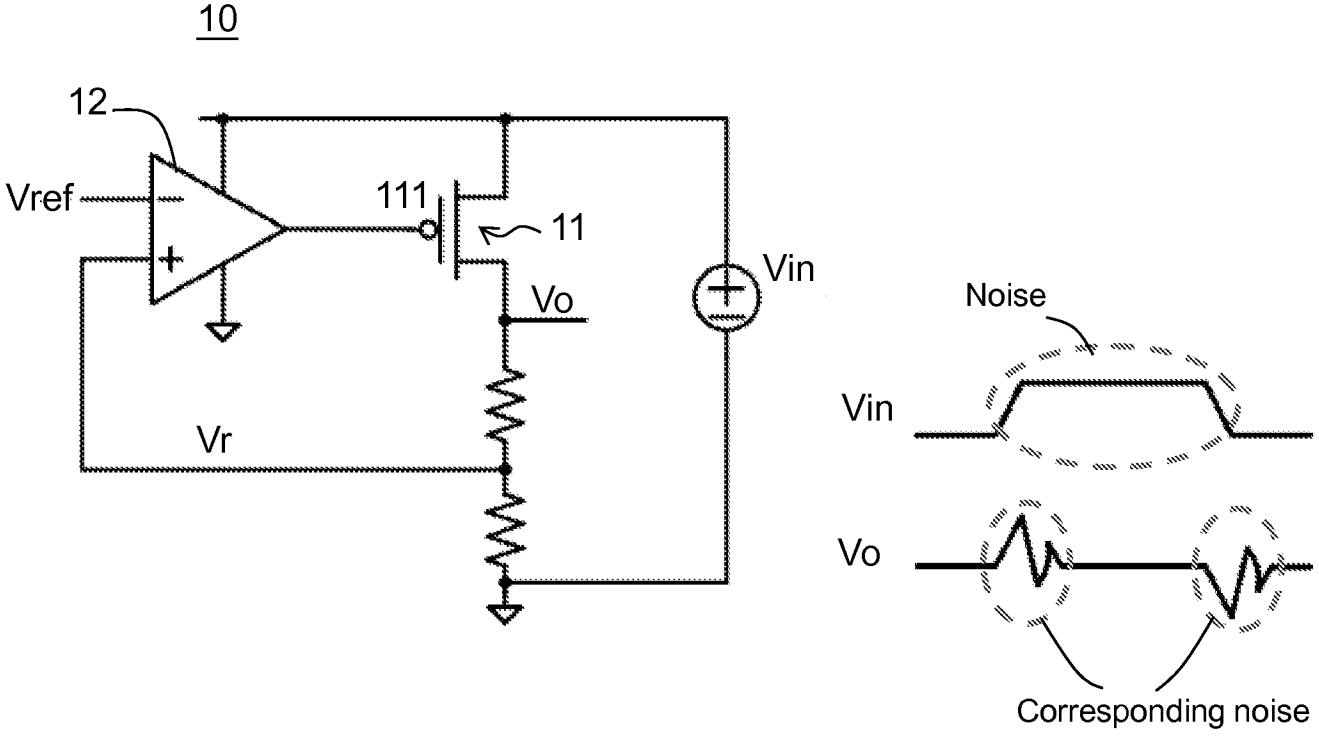
Fig. 1 (Prior art)
FIG. 1 shows a linear regulator circuit according to prior art.
Figure 2:
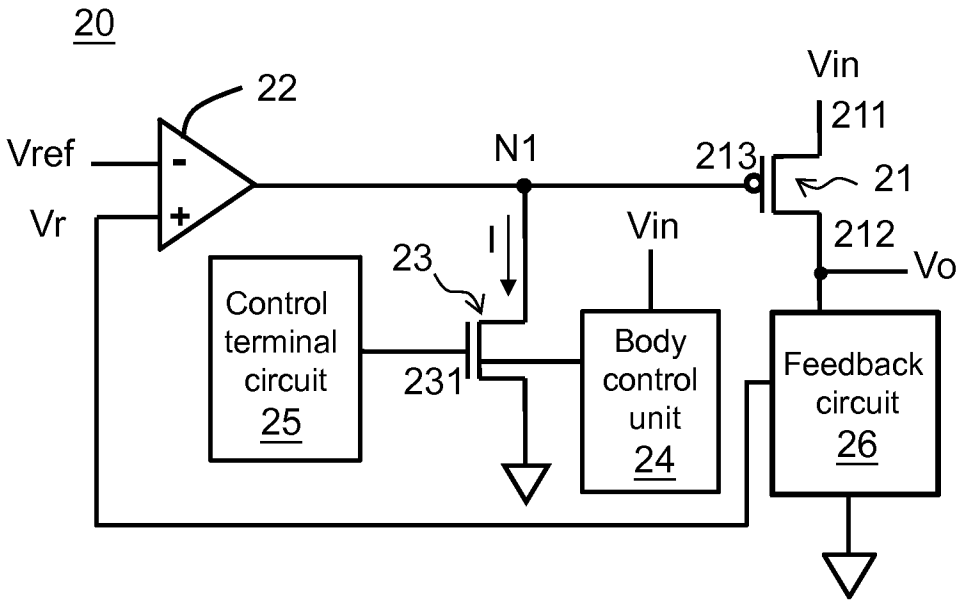
FIGS. 2-4 show linear regulator circuits according to several embodiments of the present invention.

FIG. 2 shows a linear regulator circuit 20 according to one embodiment of the present invention, which includes a power switch 21, an error amplifier 22, a first node N1, a transistor 23, and a body control unit 24. The power switch 21 has a first terminal 211 coupled to an input voltage Vin, a second terminal 212 coupled to an output voltage Vo, and a control terminal 213. The error amplifier 22 controls the control terminal 213 of the power switch 21 according to a comparison between a feedback signal Vr related to the output voltage Vo and a reference signal Vref. The feedback signal Vr for example can be generated from the output voltage Vo through a feedback circuit 26, or directly obtained from the output voltage Vo; the feedback circuit 26 for example can be, but is not limited to, a voltage divider circuit. The first node N1 is coupled between the error amplifier 22 and the control terminal 213 of the power switch 21. The transistor 23 is coupled to the first node N1, to provide a current path. The body control unit 24 is coupled to the input voltage Vin, and the body control unit 24 controls a body of the transistor 23. When a change occurs in the input voltage Vin, the body control unit 24 controls a body voltage of the transistor 23 to adjust a current I in the current path, to correspondingly control a voltage at the first node N1, such that the control terminal 213 of the power switch 21 quickly responds to the change in the input voltage Vin.

In detail, when the linear regulator circuit 20 operates at a stable status, a gate-source voltage of the power switch 21 is maintained at an appropriate value whereby the power switch 21 can appropriately convert the input voltage Vin to the output voltage Vo. When there is a sudden change in the input voltage during this stable status, the control terminal 213 of the power switch 21 should respond to this change instantly to recover the gate-source voltage of the power switch 21 back to the appropriate value. For example, when the input voltage Vin increases suddenly, the gate voltage (the voltage at the control terminal 213) of the power switch 21 should increase correspondingly, such that the gate-source voltage of the power switch 21 can be quickly recovered to the appropriate value. On the other hand, when the input voltage Vin decreases suddenly, the gate voltage of the power switch 21 should decrease correspondingly, such that the gate-source voltage of the power switch 21 can be quickly recovered to the appropriate value.

In one embodiment, that "the gate-source voltage of the power switch 21 is quickly recovered to the appropriate value" is achieved by the body control unit 24 by controlling the body voltage of the transistor 23. Referring to the embodiment shown in FIG. 2, when the input voltage Vin increases suddenly, the body control unit 24 controls the body voltage of the transistor 23 in response to the increase of the input voltage Vin, to decrease the current I by the transistor body effect. Because the current I flowing through the transistor 23 decreases, the voltage at the first node N1 increases, such that the voltage at the control terminal 231 of the power switch 21 increases correspondingly.

In another case, when the input voltage Vin decreases suddenly, the body control unit 24 controls the body voltage of the transistor 23 in response to the decrease of the input voltage Vin, to increase the current I by the transistor body effect. Because the current I flowing through the transistor 23 increases, the voltage at the first node N1 decreases, such that the voltage at the control terminal 231 of the power switch 21 decreases correspondingly.

In the above embodiment, the body control unit 24 controls the body voltage of the transistor 23 in response to the instant change of the input voltage Vin, to increase or decrease the current I. It should be explained that the increase or decrease of the current I is dependent on the coupling relation between the control terminal 213 of the power switch 21 and the first node N1. In the embodiment of FIG. 2, it is assumed that there is a positive correlation between the voltage variation at the first node N1 and the voltage variation at the control terminal 213 of the power switch 21, i.e., when one increases, the other also increases, and when one decreases, the other also decreases. However, if there is any circuit or device coupled between the first node N1 and the control terminal 213 of the power switch 21, which results in a negative correlation between the voltage variation at the first node N1 and the voltage variation at the control terminal 213 of the power switch 21, the body control unit 24 should control the body voltage of the transistor 23 in response to the change of the input voltage Vin by a different manner (please refer to the embodiments below).

Figure 3:
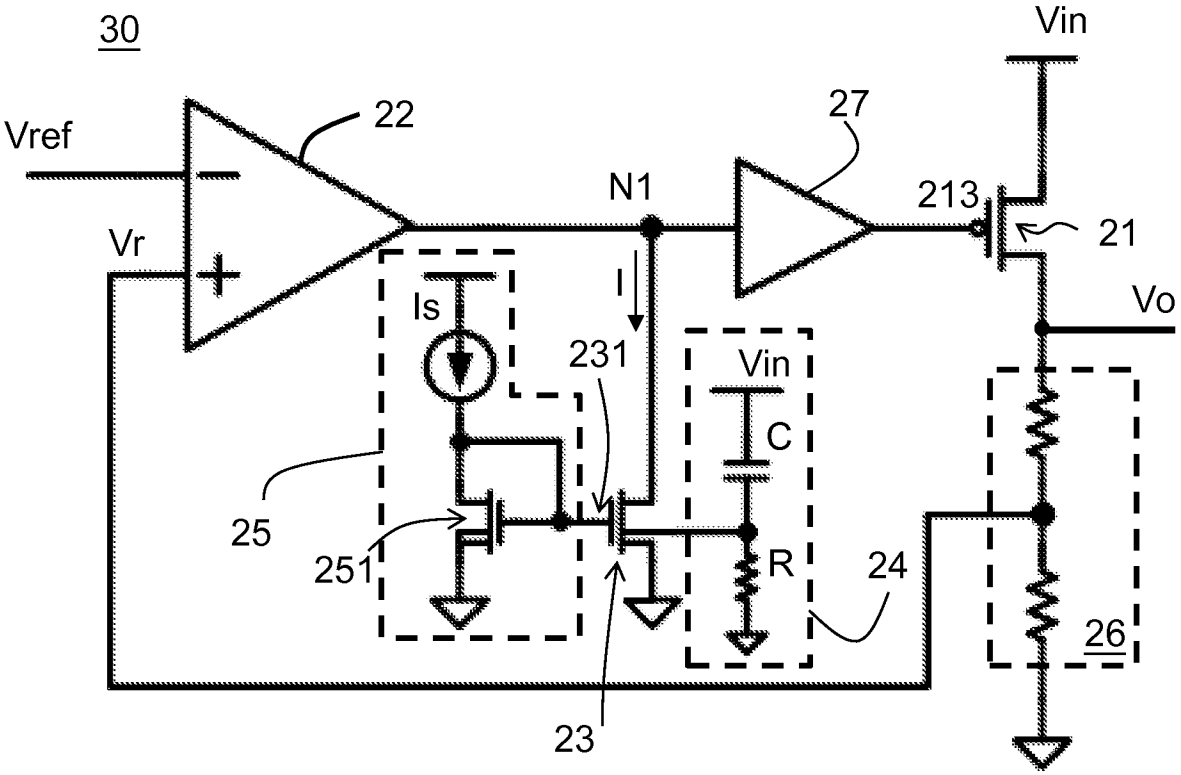

Still referring to FIG. 2, the control terminal 231 of the transistor 23 is coupled to a control terminal circuit 25. The function of the control terminal circuit 25 is to maintain the control terminal of the transistor 23 at an appropriate voltage level such that the current I flowing through the transistor 23 can be adjusted by the body voltage of the transistor 23. Please refer to the linear regulator circuit 30 of FIG. 3. In one embodiment, the control terminal circuit 25 includes another transistor 251, and the transistors 23 and 251 forma current mirror circuit. As shown in FIG. 3, the transistor 251 can be coupled to a current source Is, so that the current I has a basic current amount and its variation is controlled by the body voltage of the transistor 23.

Still referring to FIG. 3, the linear regulator 30 further includes a feedback circuit 26, coupled between the output voltage Vo and the error amplifier 22. The feedback circuit 26 generates the feedback signal Vr according to the output voltage Vo, and transmits the feedback signal Vr to the error amplifier 22. In one embodiment shown in FIG. 3, the feedback circuit 26 can be a voltage divider circuit formed by two resistors. However, if the voltage level of the output voltage Vo is acceptable by the error amplifier 22, the feedback circuit 26 can be omitted.

In one embodiment, the body control unit 24 includes a high pass filter, which is coupled between the input voltage Vin and the body of the transistor 23. In one embodiment, the high pass filter includes a capacitor C and a resistor R connected in series, wherein the capacitor C is coupled between the input voltage Vin and the resistor R; the resistor R is coupled between the capacitor C and ground; and a second node N2 between the capacitor C and the resistor R is coupled to the body.

As shown in FIG. 3, the linear regulator circuit 30 can further include an amplifier 27, coupled between the first node N1 and the control terminal 213 of the power switch 21, to amplify the voltage at the first node N1 for controlling the power switch 21.

Figure 4:
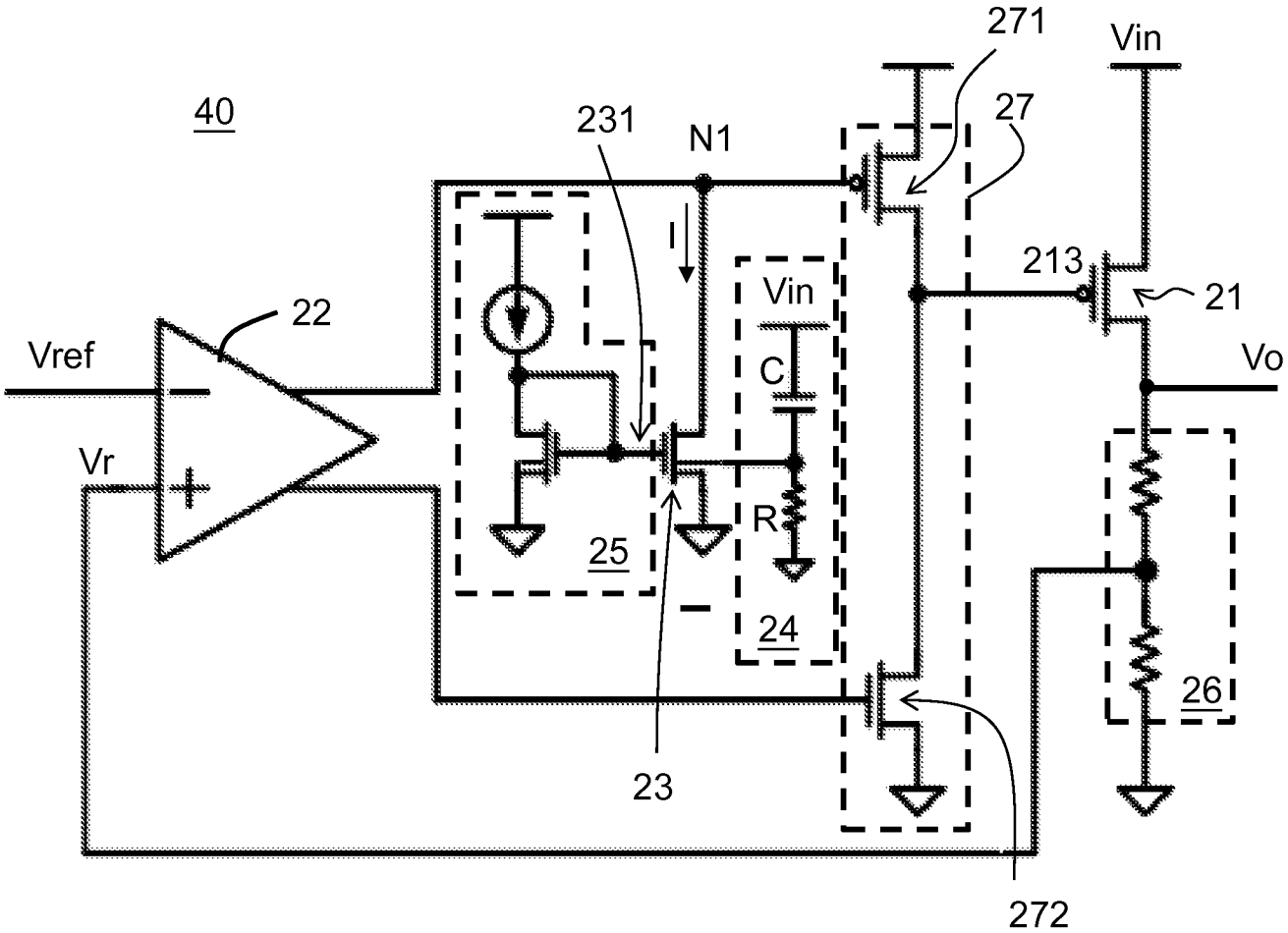

As shown in FIG. 4, the amplifier 27 for example includes a PMOS transistor 271 and a NMOS transistor 272. When the input voltage Vin increases suddenly, the body control unit 24 controls the body voltage of the transistor 23 in response to the voltage increase. For example, when the input voltage Vin is a high frequency signal, the impedance of capacitor C decreases, and the body voltage of the transistor 23 increases in response to the increase of the input voltage Vin. By the transistor body effect, the current I flowing from the first node N1 through the transistor 23 to ground increases. Because the current I increases, the voltage at the first node N1 decreases, and the conduction status of the PMOS transistor 271 correspondingly increases. Hence, the voltage at the control terminal 231 of the power switch 21 correspondingly increases in response to the change of the input voltage Vin.

When the input voltage Vin decreases suddenly, the body control unit 24 controls the body voltage of the transistor 23 in response to the voltage decrease. For example, when the input voltage Vin is a high frequency signal, the impedance of capacitor C decreases, and the body voltage of the transistor 23 decreases in response to the decrease of the input voltage Vin. By the transistor body effect, the current I flowing from the first node N1 through the transistor 23 to ground decreases. Because the current I decreases, the voltage at the first node N1 increases, and the conduction status of the PMOS transistor 271 correspondingly increases. Hence, the voltage at the control terminal 213 of the power switch 21 correspondingly decreases in response to the change of the input voltage Vin.

In comparison with U.S. Pat. No. 6,541,946 which connects the control terminal of the transistor on the current path to a capacitor and connects the capacitor to the input voltage Vin, the present invention controls the body voltage of the transistor 23, so the control terminal 231 of the transistor 23 is not directly connected to a capacitor, and the current source Is and the capacitor C of the present invention do not require to be a large current source and a large capacitor. Hence, the present invention is superior to the prior art.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. Besides, a device or a circuit which does not affect the primary function of the units can be inserted between two units shown to be in direct connection in the figures of the present invention. An embodiment or a claim of the present invention does not need to attain or include all the objectives, advantages or features described in the above. The abstract and the title are provided for assisting searches and not to be read as limitations to the scope of the present invention.

What is claimed is:

1. A linear regulator circuit, comprising:

a power switch having a first terminal coupled to an input voltage, a second terminal coupled to an output voltage, and a control terminal;

an error amplifier, controlling the control terminal of the power switch according to a comparison between a feedback signal related to the output voltage and a reference signal;

a first node, coupled between the error amplifier and the control terminal of the power switch;

a transistor, coupled to the first node to provide a current path; and a body control unit, coupled between the input voltage and a body of the transistor, wherein when a change occurs in the input voltage, the body control unit controls a body voltage of the transistor such that the body voltage is adjusted to adjust a current in the current path, to correspondingly control a voltage of the first node, such that the control terminal of the power switch responds to the change.

2. The linear regulator circuit of claim 1, wherein the control terminal of the transistor is not directly connected to a capacitor.

3. The linear regulator circuit of claim 1, further comprising a feedback circuit, coupled between the output voltage and the error amplifier, the feedback circuit generating the feedback signal to the error amplifier according to the output voltage.

4. The linear regulator circuit of claim 1, wherein the body control unit comprises a high pass filter, coupled between the input voltage and the body of the transistor.

5. The linear regulator circuit of claim 4, wherein the high pass filter comprises a capacitor and a resistor connected in series, wherein the capacitor is coupled between the input voltage and the resistor; the resistor is coupled between the capacitor and ground; and a second node between the capacitor and the resistor is coupled to the body of the transistor.

6. The linear regulator circuit of claim 1, wherein a control terminal of the transistor is coupled to another transistor, the transistor and the another transistor form a current mirror circuit.

7. The linear regulator circuit of claim 6, wherein the another transistor is coupled to a current source.

8. The linear regulator circuit of claim 1, further comprising an amplifier, coupled between the first node and the control terminal of the power switch, for amplifying a voltage at the first node to control the power switch.

* * * * *